United States Patent [19]

Parker et al.

[11] 4,184,814

[45] Jan. 22, 1980

[54] VALVE GUIDE FOR POPPET VALVE

[75] Inventors: Curtis J. Parker, Orangefield; Kenneth H. McGill, Beaumont, both of Tex.

[73] Assignee: Dresser Industries, Inc., Dallas, Tex.

[21] Appl. No.: 889,318

[22] Filed: Mar. 23, 1978

Related U.S. Application Data

[63] Continuation of Ser. No. 698,574, Jun. 22, 1976, abandoned.

[51] Int. Cl.[2] ..... F04B 39/14

[52] U.S. Cl. ..... 417/454; 417/568; 137/454.4

[58] Field of Search ..... 417/454, 568, 297; 137/543.13, 543.19, 542, 543, 454.4

[56] References Cited

U.S. PATENT DOCUMENTS

| | | | |
|---|---|---|---|
| 666,089 | 1/1901 | Dillon | 137/454.4 |
| 1,595,459 | 8/1926 | Durant | 137/543.13 |
| 1,602,372 | 10/1926 | Bullon | 137/543.19 |
| 1,770,683 | 7/1930 | Davis | 417/554 |
| 2,233,649 | 3/1941 | Stahl | 137/543.13 |
| 2,304,991 | 12/1942 | Foster | 137/454.4 |
| 2,949,928 | 8/1960 | Hobson | 137/542 |
| 3,430,575 | 3/1969 | Roth | 417/468 |
| 3,474,808 | 10/1969 | Elliott | 137/543 |

FOREIGN PATENT DOCUMENTS

| | | | |
|---|---|---|---|
| 1042172 | 1/1956 | Fed. Rep. of Germany | 417/297 |

*Primary Examiner*—William L. Freeh
*Attorney, Agent, or Firm*—Richard M. Byron

[57] ABSTRACT

A poppet valve guide mechanism for use in pumps such as piston type pumps, utilizes a valve guide collar secured to a crossbar support and retained by a locking bar transverse thereto.

7 Claims, 9 Drawing Figures

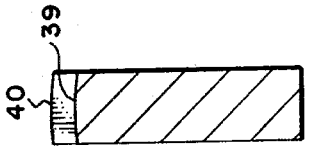
FIG. 3B
FIG. 1
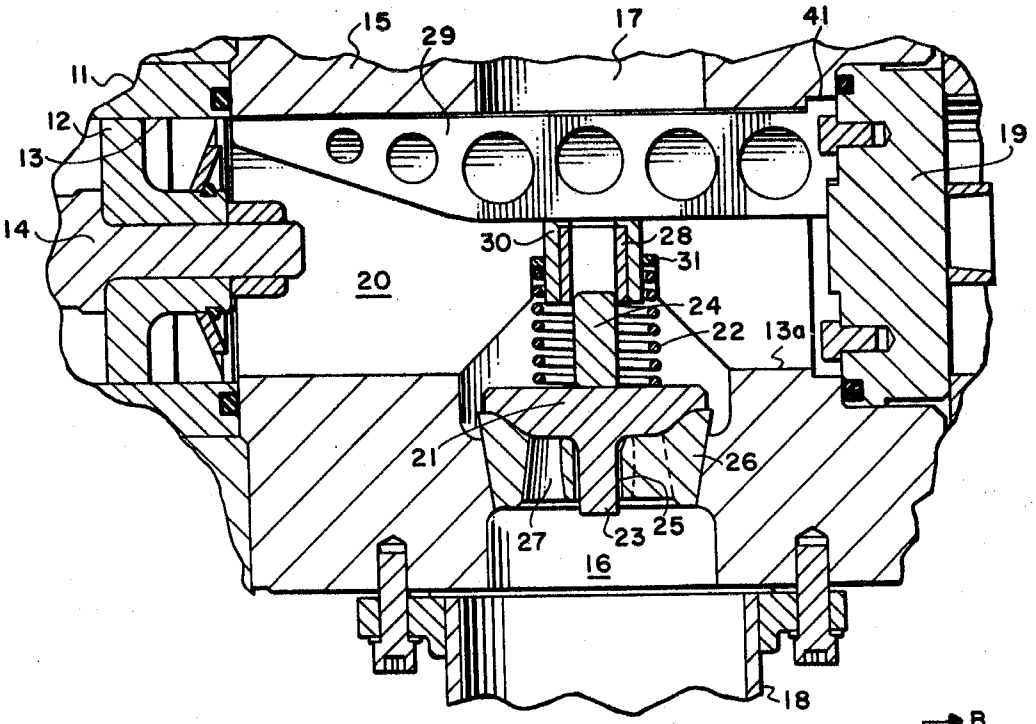
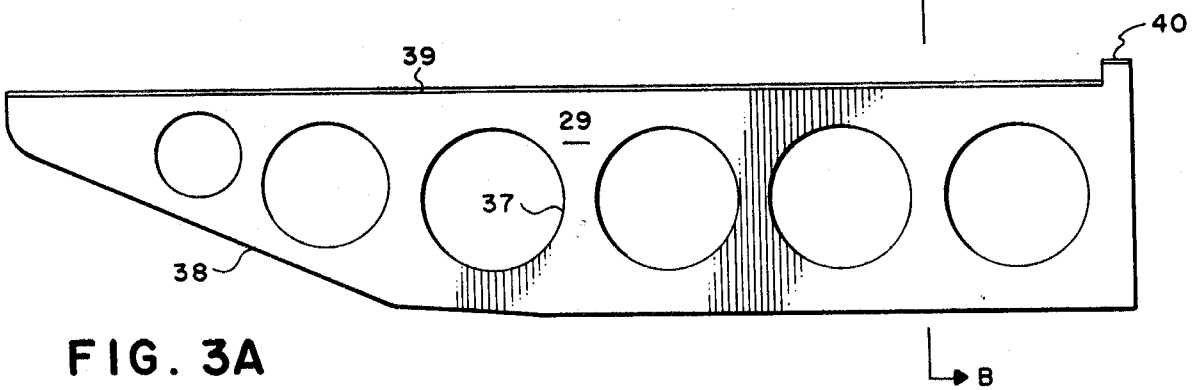
FIG. 3A

VALVE GUIDE FOR POPPET VALVE

This is a continuation of application Ser. No. 698,574, filed June 22, 1976 now abandoned.

BACKGROUND OF THE INVENTION

In the construction of pumps and more particularly in the construction of large pumps such as the piston type triplex pumps utilized in drilling and servicing of oil wells, one particularly troublesome area in the pump construction involves the valving structure in the fluid end of the pump. Each cylinder of the pump generally has associated therewith a suction end and a discharge end each of which communicates the pumped fluid end with intake and discharge conduits via valving arrangements such as poppet valves.

A particularly troublesome area in the construction of the valving systems in pumped fluid ends involves providing guide assemblies for these poppet valves which provide lateral support yet allow the valves to move vertically into and off of the valve seat. The suction and discharge valves of these large triplex pumps are usually spring loaded poppet valves having valve stems at both ends of the valve member. The valve stems provide an elongated portion of the valve for extension into a cylindrical or other shaped valve guide opening which prevents lateral distortion of the valve member during its cyclic operation.

A particular problem arises in the valve guide construction of the intake valve in a large multiplex pump because of the necessary requirement that the inner valve stem portion of the valve must be guided within a valve guide located inside the flow area of the pump fluid end. Such valve guide must be removable from the fluid end for repair and replacement of the valve member and other pump parts, yet the valve guide must be easily placed within the fluid end in such an orientation that it provides rigid dependable valve guiding operation.

The pumps available today utilize valve guides on the intake valve which valve guides are secured by means such as bolts, clamps, set screws and other arrangements. These valve guide anchoring means suffer form the disadvantages that they are complex and difficult to install. The problems arise from the close working space within the fluid end which restricts movement of the mechanic during installation and removal of the valve components.

Thus, the bolting, clamping and other arrangements require extensive use of hand tools within the narrow confines of the fluid end making change-out of pump components extremely difficult and hazardous for the working personnel. The present invention provides valve guide arrangements which may be installed within the fluid end of a large pump by means requiring no bolting or clamping or other complex securing arrangements.

BRIEF DESCRIPTION OF THE DRAWINGS

FIG. 1 is a side cross-sectional view of the valving apparatus installed in the fluid end of a piston type pump.

Figure 2A:
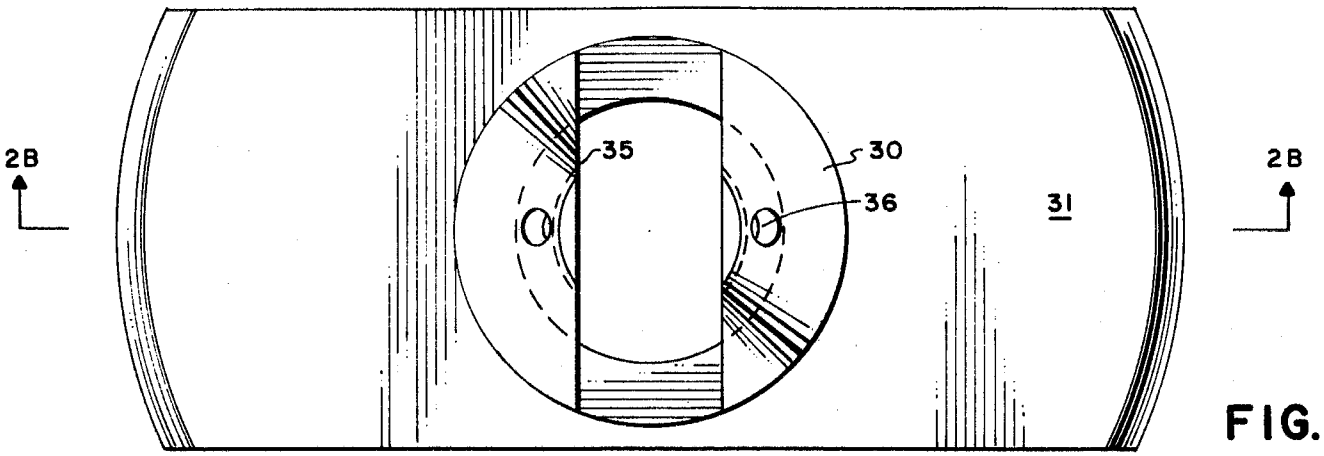
Figure 2B:
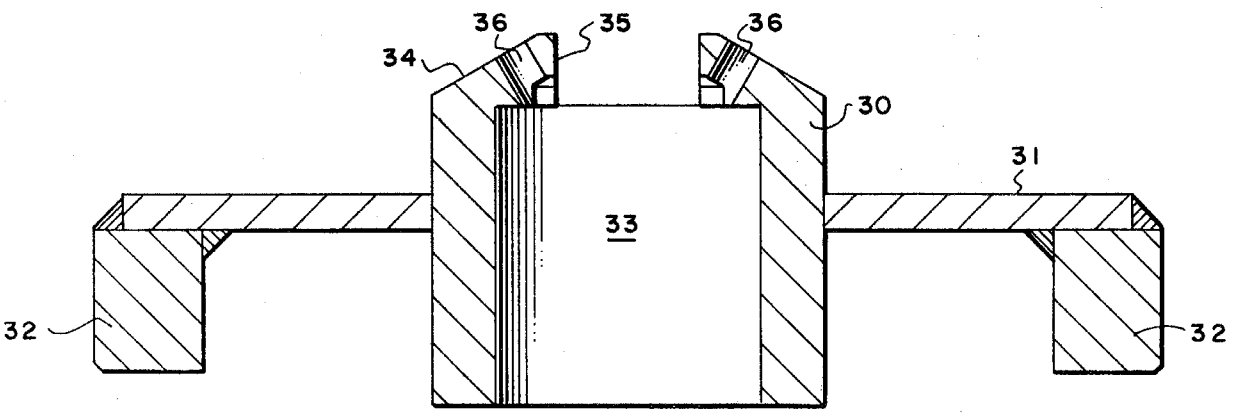

FIGS. *2a* and *2b* illustrate a portion of the valve guide apparatus.

FIGS. *3a* and *3b* illustrate the support bar for the valve guide apparatus.

FIGS. *4a* and *4b* illustrate schematic views of the valve guide arrangement with the valve in place.

FIGS. *5a* and *5b* illustrate an alternate embodiment of the valve guide apparatus.

DESCRIPTION OF THE PREFERRED EMBODIMENTS

FIG. 1 is a partial cross-sectional view of a piston type pump 11 having a generally cylindrical fluid piston 12 mounted at the end of an elongated piston rod 14 and slidably located within pump cylinder 13. A fluid end assembly 15 is attached by means such as bolts to the end of pump 11 in communication with cylinder 13. Fluid end 15 has an intake bore 16 and a discharge bore 17. A fluid supply conduit 18 is clamped to fluid end 15 in communication with bore 16. The extension of cylinder 13 denoted as bore 13*a* past bores 16 and 17 is closed off by a bore plug 19 secured to the fluid end and sealingly engaged therein.

During operation of the pumping cylinder illustrated, the piston 12 and rod 14 move to the left in cylinder 13 thereby establishing a suction within fluid end chamber 20 which suction reacts on valve member 21 moving it inward into bore 20 against the compression of spring 22 thereby drawing in fluid from conduit 18. Valve 21 is provided with an upstream stem 23 and a downstream stem 24 with the upstream stem 23 being slidable within a central opening 25 of the valve seat insert 26. Valve seat 26 has one or more flow passages 27 therethrough for communication of fluid from bore 20 to bore 16. Valve stem 24 is slidably located within a generally cylindrical valve guide collar 30 having a elastomeric inner liner 28 located concentrically therewithin. An elongated relatively flat support bar 29 is provided for abutment with the upper extremity of bore 20 and simultaneous abutment and locking engagement with collar 30.

Referring now to FIGS. *2a* and *2b*, the guide collar 30 is shown with a lateral support plate 31 securedly attached thereto and extending outwardly from diametrically opposed sides of collar 30. Support plate 31 has at each end a downward projecting abutment shoulder 32. Collar 30 is a generally cylindrical member having a guide passage 33 therein, a generally frustro-conical upper surface 34, and a transverse lateral slot 35 passing through the top thereof. One or more fluid pressure relief ports 36 are also provided through the top of collar 30. Support plate 31 may be secured to collar 30 by any acceptable means such as welding or press-fitting. In FIG. 1, support plate 31 is viewed in cross-sectional end view and appears in abutment with spring 22.

FIGS. *3a* and *3b* illustrate the support bar 29 of FIG. 1. The bar is a substantially flat elongated plate having a plurality of openings 37 therethrough for lightening the member and for providing flow relief therethrough. The bar 29 has a sloped edge 38, a rounded straight edge 39, and a raised shoulder 40 at one end. FIG. *3b* illustrates a cross-sectional view of bar 29 taken at line *b—b* of FIG. *3a*. FIG. *3b* illustrates the rounded side 39 and the rounded shoulder 40 along one edge of the bar. Bar 29 is sized for relatively close fitting engagement within channel 35 of collar 30. Furthermore, the curvature of side 39 and shoulder 40 is selected to coincide generally with the curvature of the wall of bore passage 20 in the fluid end.

FIG. *4a* illustrates a schematic top view of the guide assembly looking downward toward the valve member 21. A pair of opposed ledges 42 are provided within the vertical bore 16 and 17 of the fluid end for allowing abutment thereon of shoulders 32 of support plate 31. The placement of shoulders 42 is arranged to allow relatively tight fitting engagement of the support plate 29 between collar 30 and the upper surface of bore passage 20.

Figure 4A:
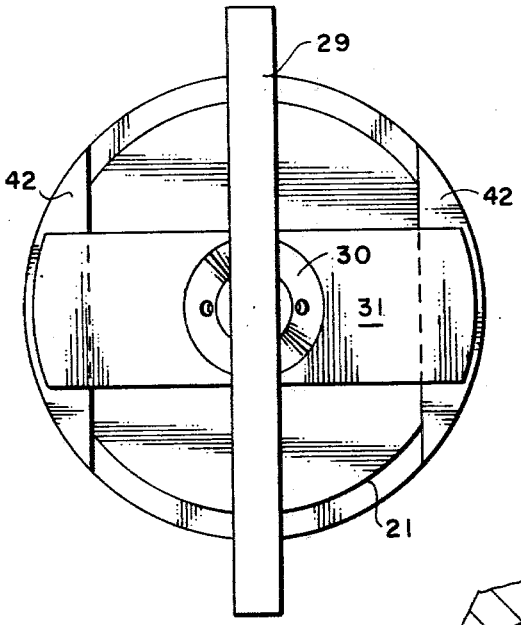
Figure 4B:
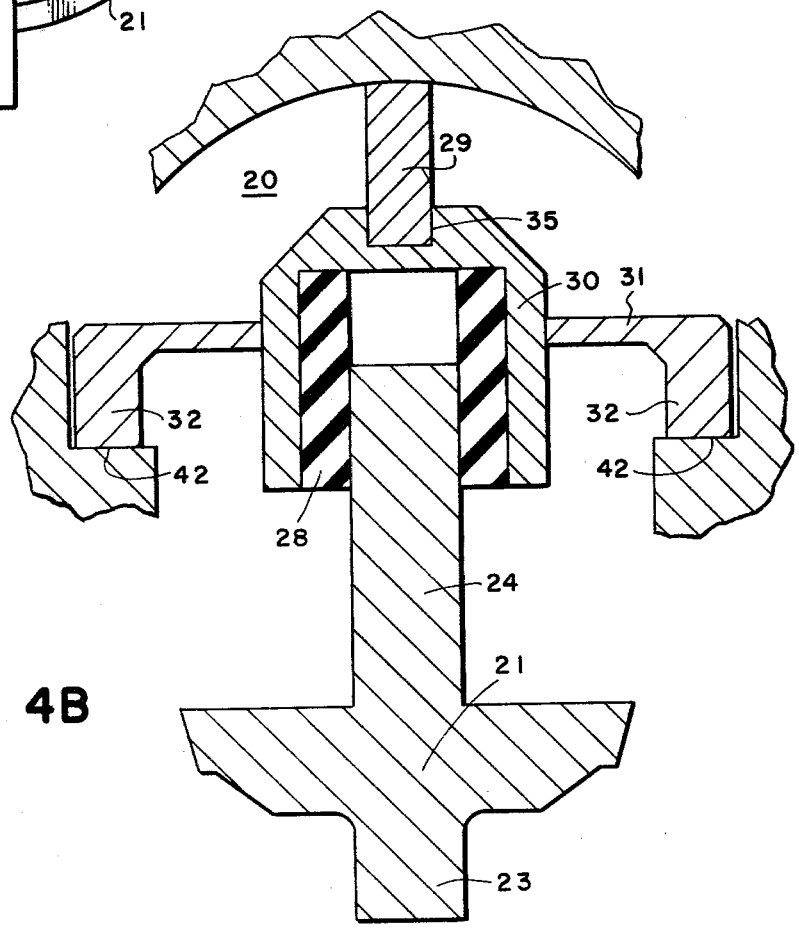

Referring to FIG. 4*b*, the guide assembly is shown in place in bore passage 20 and placement of the valve 21 is shown merely for purposes of illustration. It should be noted that the coil spring 22 normally would be placed in compression between plate 31 and the annularly extending portion of valve 21. As previously mentioned, the location of support ledges 42 is arranged such that when support plate 31 is placed thereon, the engagement of bar 29 in channel 35 will provide a downward tightening of the valve guide arrangement within bore 20. More specifically, it is preferable that a slight flexing of plate 31 is achieved when bar 29 is moved into place in channel 35 in abutment with the upper wall of bore 20.

An elastomeric guide sleeve 28 provides sliding contact between the valve stem 24 and the valve guide mechanism. Assembly of the valve guide mechanism about the valve is accomplished by the following procedure: The spring 22 is first placed about the valve stem. The valve guide collar 30 with support plate 31 is located over the spring until the collar 30 extends over the valve stem inside the spring resulting in abutment of the upper portion of the spring with the bottom side of plate 31. The plate 31 may then be rotated about the valve stem 24 until shoulders 32 are located directly above ledges 42 and then the collar may be compressed downward over the spring until the support bar 29 is inserted, narrow end first, into the channel. As the narrow end of bar 29 moves through the channel, the wider portion of the bar will serve to wedge the collar and support plate 31 down into tight abutting engagement on ledges 42 until the bar 29 has been moved completely into its proper location in the fluid end. Proper location of the bar is insured by providing a recess 41 in the fluid end which recess 41 is shaped generally to compliment shoulder 40 of bar 29, which shoulder 40 when engaged in recess 41 insures proper alignment and placement of support bar 29. The bore plug 19 is then replaced and provides abutting engagement with bar 29, maintaining it in proper lateral orientation. The combination of the abutment of plug 19 and the engagement of shoulder 40 in recess insures no movement of bar 29 can occur during the cyclic operation of the pumping apparatus.

Figure 5B:
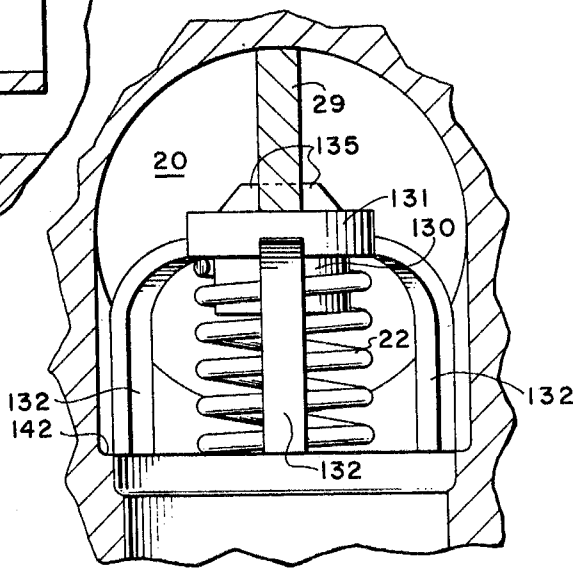
Figure 5A:
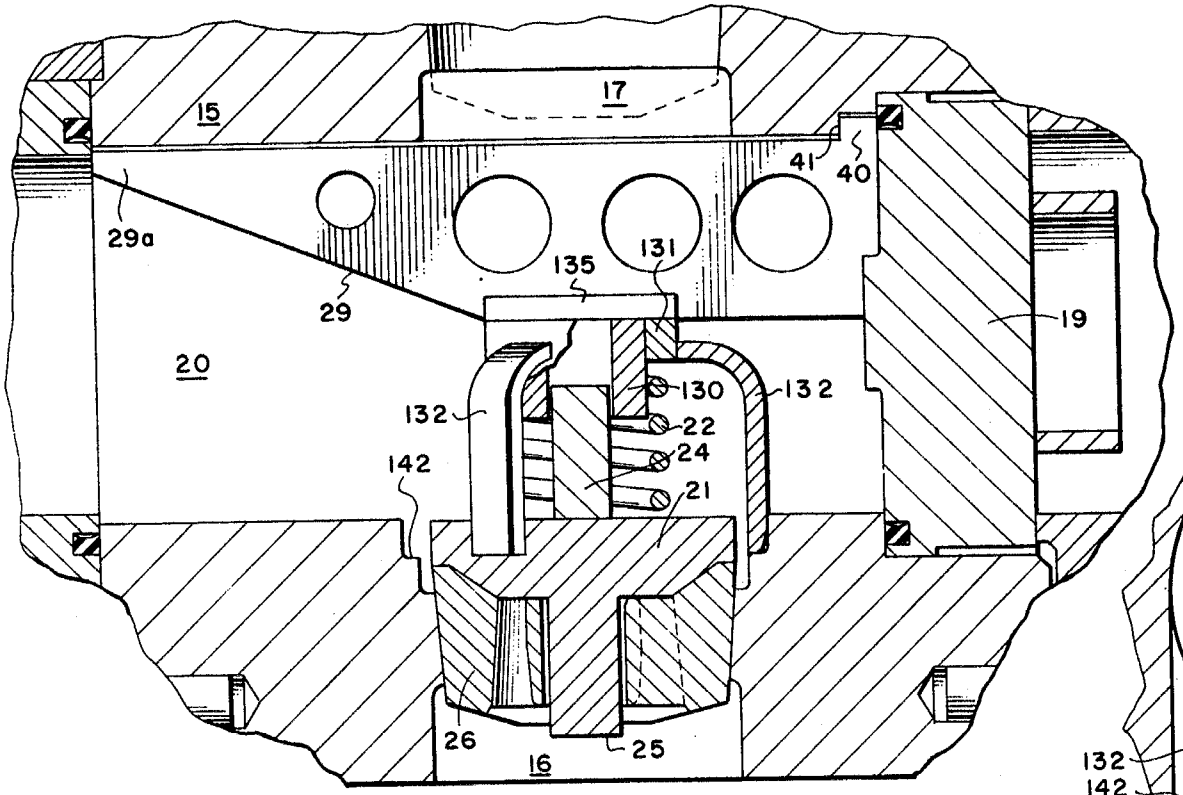

FIGS.5*a* and 5*b* illustrate an alternate embodiment of the valve guide mechanism utilizing a tripod support arrangement rather than the lateral bar arrangement of the first embodiment. In this embodiment, a generally cylindrical valve guide collar 130 is securedly fixed into a horizontal foundation plate 131 to which are attached three equally spaced arcuate support legs 132. A counter bore 142 is formed in the upper portion of passage 16 resulting in an inwardly extending annular ledge. The three support legs 132 of the guide collar mechanism are adapted for engagement within the counter bore 142 abutting the resultantly formed inwardly extending annular ledge.

A pair of transverse shoulders 135 are attached to the top of plate 131 in such a manner as to form a transverse seating channel for receiving a relatively snug fitting relationship with the support bar 29. The support plate 131 is adapted to provide an annular abutting surface outside of collar 130 for receiving in abutment coil spring 22 encircling the valve stem 24.

Assembly of the valve guide mechanism within the pump fluid end is achieved by placing the coil spring 22 over the valve stem, lowering the tripod valve guide over the coil spring and valve stem 24 and compressing the valve guide downward on the spring 22 until the three support legs 132 bottom-out in counter bore 142. The transverse support bar 29 is then slid through the channel formed by shoulders 135 until the locking shoulder 40 on bar 29 engages in locking recess 41 formed internally within the fluid end housing 15. Thus it can be seen that the present invention provides a dependable yet easily installed valve guide arrangement for reciprocating poppet type valves which arrangement has the advantage of being easily insertable and removable from the valving mechanism and yet still provides superior valve guide operation.

Although certain preferred embodiments of the invention have been herein described in order to provide an understanding of the general principles of the invention, it will be appreciated that various changes and innovations can be effected in the described valve guide mechanism without departing from these principles. For example, it is obvious that one could alter the number of legs provided on the valve guide support structure. Any number of legs from three on up could be utilized, limited only by the space provided around the counter bore ledge. Also, it would be possible to make the support legs wider or narrower or make them shorter or longer. The collar and plate could be made as an intergral unit or the collar could be used alone with the support legs attached directly to the collar and providing abutment for the coil spring. It is also obvious that a liner of some other material, such as a elastomeric material, could be used inside the guide collar. The invention therefore is declared to cover all changes and modifications of the specific example of the invention herein disclosed for purposes of illustration which do not constitute departures from the spirit and scope of the invention.

The embodiments of the invention in which an exclusive property or privilege is claimed are defined as follows:

1. In a reciprocating pump having a housing with a fluid end including a piston mounted in a piston chamber and with a reciprocating spring biased stemmed valve therein arranged for alternately communicating discharge and suction pressures with a pumped fluid chamber formed by a longitudinal extension of said piston chamber, a valve guide assembly, comprising:

an annular ledge in said housing around and radially outward of said valve;

a support plate being an elongated, substantially flat and of a generally rectangular cross-section extending transversely across a mid portion of said pumped fluid chamber and having arcuate end portions extending in a downward direction toward said valve with ends thereof abutting said ledge at opposite sides of said valve within said pumped fluid chamber;

a valve guide mounted transversely through a mid portion of said support plate to slidably receive and mount the stem of a valve member through a lower side portion thereof; and a support bar wedged between an upper side portion of said valve guide and a wall surface of said pumped fluid chamber, said support bar being adapted to retain said support plate in tight abutment with said ledges in order to retain a reciprocating valve member and the associated spring thereof in a valve seat located in the housing.

2. The valve guide assembly of claim 1 further comprising an elastomeric contact sleeve mounted in said guide passage to slidably mount the stem of said valve.

3. The valve guide assembly of claim 1, wherein said valve guide comprises cross-sectionally circular guide passage in said support plate, said valve guide having an opened end to receive the stem of said valve and a closed end, with a transverse slot through said closed end adapted to relatively snug fitting engagement with said support bar.

4. The valve guide assembly of claim 3, wherein said support bar comprises an elongated plate having a tapered wedged portion at one end portion thereof operable to facilitate easy insertion of said support bar by facilitating a gradual displacement of said valve spring as said support bar is installed and including a uniform thickness mid portion resting in operable contact with said support plate to secure same in an operating position, and a locking tab means at the opposite end of said support bar adapted to operably engage an associated locking means in said housing to secure said support bar in a fixed position.

5. In a reciprocating piston pump having a housing with a pumped fluid chamber therein, an inlet passageway to said fluid chamber, an outlet passageway from said fluid chamber and a spring biased normally closed intake valve member mounted at the juncture of said inlet and said pumped fluid chamber and having a stem extending from said valve member into said pumped chamber with a spring positioned around said stem, an improved inlet valve mounting assembly, comprising:

an access opening through said housing at said pumped fluid chamber, generally longitudinally aligned with a pump piston and normally closed by a bore plug;

a ledge formed in said housing around and radially outward of said intake valve at the juncture of said inlet passageway at said pumped fluid chamber;

a support plate having an elongated substantially flat portion extending across said inlet and having downturned arcuate end portions supported by said ledge mean and including a guide passage through a mid portion thereof to slidably receive and guide said valve stem;

a lockiing bar mounted in said guide passage between said support plate and against an inner wall of said pumped fluid chamber, said locking bar being forcibly slid between said support plate and said inner wall to hold said support plate in tight engagement with said ledge mean;

means to secure said locking bar in fixed position between said support plate and said inner wall including a shoulder on said locking bar mounted in a housing recess at said pumped fluid chamber and said access opening and retained in said recess by said bore plug.

6. The apparatus of claim 5 wherein said guide passage comprises a generally cylindrical sleeve extending through said support plate and wedgedly secured thereto with an opened end and a slotted end; said slotted end being adapted for snug fitting engagement about said locking bar.

7. The apparatus of claim 5 wherein said locking bar has a tapered end portion on the end thereof opposite to said shoulder to provide for easy installation of same.

* * * * *